US005880658A

United States Patent [19]

Donhauser et al.

[11] Patent Number: 5,880,658

[45] Date of Patent: Mar. 9, 1999

[54] ELECTROMAGNETIC SWITCH

[75] Inventors: Peter Donhauser; Johann Drexler, both of Schwandorf; Wilhelm Holzer, Amberg, all of Germany

[73] Assignee: Siemens Aktiengesellschaft, München, Germany

[21] Appl. No.: 973,294

[22] PCT Filed: May 15, 1996

[86] PCT No.: PCT/DE96/00864

§ 371 Date: Feb. 19, 1998

§ 102(e) Date: Feb. 19, 1998

[87] PCT Pub. No.: WO96/38851

PCT Pub. Date: Dec. 5, 1996

[30] Foreign Application Priority Data

May 30, 1995 [DE] Germany ..... 195 19 756.9

[51] Int. Cl.[6] ..... H01H 67/02

[52] U.S. Cl. ..... 335/132; 335/201; 218/155

[58] Field of Search ..... 335/132, 202, 335/6, 16, 14, 20, 147, 195, 201; 218/22, 15, 18, 155

[56] References Cited

U.S. PATENT DOCUMENTS 4,307,358 12/1981 Haury et al. .
4,470,028 9/1984 Vayre et al. .
4,688,011 8/1987 Lemmer et al. ..... 335/132
4,973,929 11/1990 Duchemin ..... 335/202
5,635,886 6/1997 Pichard ..... 335/132

FOREIGN PATENT DOCUMENTS 37 13 412 12/1988 Germany .
44 24 535 1/1995 Germany .

*Primary Examiner*—Lincoln Donovan
*Attorney, Agent, or Firm*—Kenyon & Kenyon

[57] ABSTRACT

An electromagnetic switching device for operationally switching currents in the load range and having an instantaneous release, connected in series, for protection against welding of the contacts (6) in the overload range is created, and has a high reliability and low overall volume. The electromagnet (2) of the switching device (1) is arranged in the middle relative to the contact bridge carrier (8) and coupled directly to the latter in the middle. The instantaneous release (3) acts via a rocker (15) on the movable contact (6) and is actuated only in the case of overcurrents, use being made of the fact that only the directly coupled drive system of the switching device is employed in the nominal current range.

5 Claims, 1 Drawing Sheet

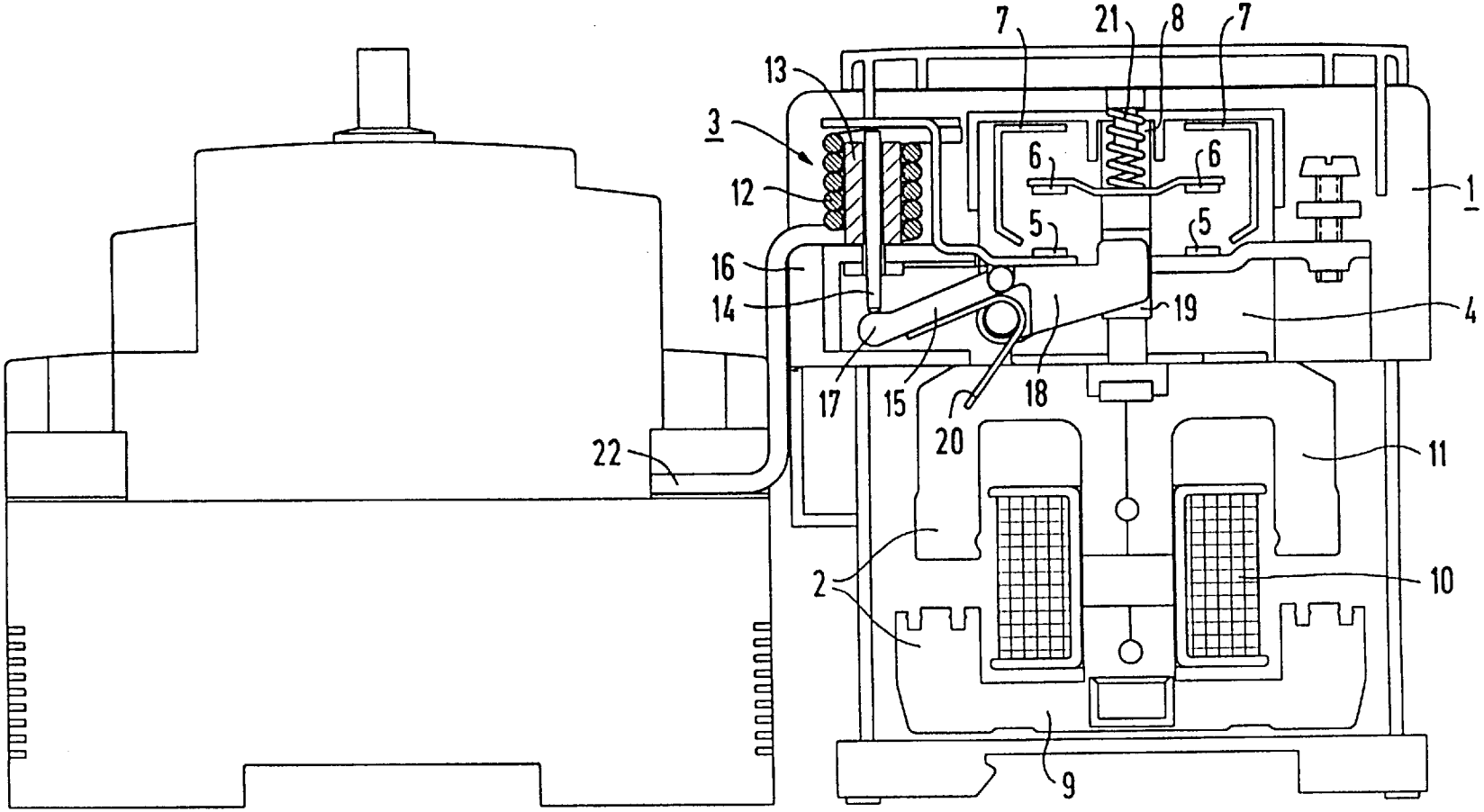
1
4
11
10
7
6
5
19
8
21
18
9
7
6
5
20
15
17
2
13
3
12
16
14
22

ELECTROMAGNETIC SWITCH

FIELD OF THE INVENTION

The present invention relates to an electromagnetic switching device having an electromagnet for operationally switching currents in the load range.

BACKGROUND INFORMATION

An electromagnetic switching device of the generic type is described in German Patent No. 37 13 412 A1. The contact bridge carrier is actuated here using a toggle by a contactor magnet arranged laterally offset with respect to the contact bridge carrier. The electromagnetic contactor drive and the instantaneous release are arranged parallel to one another on both sides of the longitudinal central axis of the contact bridge carrier. The contact springs which effect the contact pressure are supported against the housing base. A high short-circuit breaking capacity is achieved by providing extinction chambers of appropriately generous dimensions which are situated in the lower part of the housing, which is provided for mounting. However, this design entails a relatively large overall volume. The contactor magnet is fastened with its movable part to a yoke which is guided displaceably and from which a plunger projects in the direction of actuation of the contactor magnet against an operating rocker via which the contact bridge carrier can be actuated. Coupling the contactor magnet to the contact bridge carrier is therefore relatively complicated. The elements for transmitting force which are required for this purpose are exposed frequently to stresses in accordance with the switching rate, and can increase the risk of failure of the switch.

The electric switch described in German Patent No. 41 04 533 C2 is likewise of the generic type. The latter essentially comprises an arc housing and an operating or actuating mechanism housing coupled to the latter, in which the electromagnet and the instantaneous release are arranged parallel to one another. The instantaneous release is arranged in the middle relative to the contact bridge carrier, i.e. the longitudinal centre line of its striker pin for actuating the contact system is aligned with that of the contact bridge carrier. The electromagnet essentially comprises a fixed iron core, a movable iron core and a coil. Fastened to the movable iron core is a transmission component which, upon movement of the movable iron core, i.e. upon the application of current to the coil, presses on a beam which can pivot about a fixed axis of rotation and thereby releases the contact bridge carrier and effects the contact closure. Thus, the actuation of the contact bridge carrier by the electromagnet is not performed directly, but via various linkages or intermediate elements. Furthermore, the parallel arrangement of the release and of the electromagnet with respect to one another produces a relatively large overall volume.

SUMMARY OF THE INVENTION

An object of the present invention is to provide an electromagnetic switching device of the type mentioned above which has a simple switching mechanism via the electromagnets and thus ensures a high reliability and service life (for example 10 million) for switching nominal currents, without impairing the protection by the instantaneous release against welding in the case of overcurrents in the overload range. According to the present invention, this is achieved because the electromagnet is arranged in the middle relative to the contact bridge carrier and is coupled directly to the latter, and in that the instantaneous release acts on the movable contact via a rocker. This solution advantageously utilizes the fact that during the service life of the switching device the switching rate for switching currents within the nominal range is substantially higher than that of the instantaneous release for protection against overcurrents. Consequently, the stresses on the components participating in the switching in the nominal current range are very much more frequent, and thus greater. Direct coupling of the electromagnet to the contact bridge carrier is advantageous. The actuation by the instantaneous release can be performed via a rocker without loss of reliability with regard to the comparatively rare switching of overcurrents.

There is an advantageous development of the present invention when a contact pressure spring which is supported in the contact bridge carrier is provided for the purpose of exerting contact pressure. Cost advantages are thereby produced by the reduction in the magnet volume, because there is a need in the switched-off state only for a small return spring which presses the contact switch carrier into the OFF position.

It is, furthermore, advantageous when the rocker dips with one of its limbs into a window of the contact bridge carrier and is actuated only in the case of overload.

A switching device with a particularly low overall volume is achieved when the instantaneous release and the arcing chamber are arranged parallel to one another.

A simple embodiment is when the rocker is held in the open position inside or outside the instantaneous release using a torsion spring, tension spring or pressure spring.

In order to connect a circuit-breaker to the switching device, it is advantageous when there is provided on the side of the instantaneous release a terminal post which can easily be clamped onto the contact terminal screw of the circuit-breaker.

BRIEF DESCRIPTION OF THE DRAWINGS

FIG. 1 shows a electromagnetic switching device with details according to the present invention.

DETAILED DESCRIPTION OF THE INVENTION

The electromagnetic switching device 1 has an electromagnetic drive for operationally switching currents in the load range and an instantaneous release, situated in series therewith, for protection in the case of currents in the overload range. The device also has an arcing chamber 4 which has fixed contacts 5, movable contacts 6, an extinction chamber 30 with splitters 7 and a contact bridge carrier 8, relative to which an electromagnet 9, 10, 11 is arranged as contactor magnet in the middle in the adjoining space, the axes in the direction of movement of the contact bridge carrier 8 and of the electromagnet 9, 10, 11 being aligned with one another. The electromagnet, which essentially comprises a yoke 9, a coil 10 and an armature 11, is connected via its armature 11 directly to the contact bridge 8. This entails a reduction in the overall volume of the switching device and a cost saving. The instantaneous release 12, 13, 14, which likewise acts on the contact bridge carrier 8, is situated in the arcing chamber 4 in parallel next to the contact bridge carrier 8, i.e. opposite the electromagnet 9, 10, 11.

The instantaneous release 12, 13, 14 has a coil 12, a yoke 13 and an armature with an actuating pin 14 which acts on the contact bridge carrier 8 via a rocker 15. The coil 12 is connected in series to one of the fixed contacts 5 and can be connected via a terminal post 22 led out of the housing 16 of the switching device 1. The terminal post can advantageously be used for connecting a circuit-breaker. The rocker 15 dips with one 17 of its limbs into a window 19 of the contact bridge carrier 8 and, upon actuation of the release 12, 13, 14, carries the movable contact 6 along into the opening direction against the force of the contact pressure spring 21 by virtue of the fact that the actuating pin 14 presses onto the other limb 18 of the rocker 15. A contact pressure spring 21 is supported in the contact bridge carrier 8. The rocker 15 is pressed into the position closing the contacts 5, 6 by a spring 20 which acts on the limb 18.

The contact arrangement is switched within the nominal current range by using the electromagnet 9, 10, 11, which, by means of its armature 11 displaces the contact bridge carrier 8 against the back-pressure force of a return spring (not shown in FIG. 1.) in such a way that the contacts 5, 6 are closed under the action of the contact pressure spring 21 situated in the latter. If the flow of the current in the coil 10 of the electromagnet is interrupted, the contacts 5, 6 are opened by the return spring. The instantaneous release 12, 13, 14 is dimensioned in such a way that it responds in the case of overcurrents which flow via the contact arrangement and are also applied to its coil 12, and in the process its actuating pin 14 abruptly tilts the rocker 15, which immediately moves the movable contact 6 and ruptures the contacts 5, 6. Welding of the contacts 5, 6 upon the occurrence of overcurrents is prevented in this way.

FIG. 1 further shows a circuit-breaker to which the electromagnetic switching device is connected via its terminal post 22.

What is claimed is:

1. An electromagnetic switching device, comprising:

an electromagnet for operationally switching a current in a load range;

an instantaneous release connected in series with the electromagnet for protection against welding of contacts in an overload range, the instantaneous release acting upon a movable contact via a rocker;

an arcing chamber;

an extinction chamber including splitters; and a contact bridge carrier directly coupled to the electromagnet;

wherein the electromagnet is positioned in the middle in relation to the contact bridge carrier, and wherein the instantaneous release is positioned in the arcing chamber so that a first actuating direction of the instantaneous release is parallel to a second actuating direction of the contact bridge carrier.

2. The electromagnetic switching device according to claim 1, wherein a contact pressure spring is supported in the contact bridge carrier.

3. The electromagnetic switching device according to claim 1, wherein the rocker includes at least one limb, dips with one limb into a window of the contact bridge carrier and is actuated when there is an overload.

4. The electromagnetic switching device according to claim 1, wherein the rocker is held in an open position using a torsion spring.

5. The electromagnetic switching device according to claim 1 comprising a terminal post positioned on a side of the instantaneous release.

* * * * *